United States Patent [19]

Goodrum et al.

[11] Patent Number: 4,605,123

[45] Date of Patent: Aug. 12, 1986

[54] INFUSION PACKAGE

[75] Inventors: Richard W. Goodrum, Richmond; Thomas E. Bechtold; Albert A. Klimek, both of Midlothian, all of Va.

[73] Assignee: Ethyl Corporation, Richmond, Va.

[21] Appl. No.: 737,460

[22] Filed: May 24, 1985

Related U.S. Application Data

[63] Continuation of Ser. No. 561,824, Dec. 15, 1983, abandoned.

[51] Int. Cl.[4] ..... B65B 29/04

[52] U.S. Cl. ..... 206/0.5; 426/82

[58] Field of Search ..... 206/0.5; 383/77; 426/77-84

[56] References Cited

U.S. PATENT DOCUMENTS

| | | | |
|---|---|---|---|
| 1,236,285 | 8/1917 | Gallie | 383/77 |
| 1,581,578 | 4/1926 | Kieselback . | |
| 2,328,017 | 8/1943 | Irmscher . | |
| 2,359,292 | 10/1944 | Barnett . | |
| 3,054,148 | 9/1962 | Zimmerli . | |
| 3,115,967 | 12/1963 | Branstner | 426/83 |
| 3,217,971 | 11/1965 | Shvetz | 383/77 |
| 3,257,212 | 6/1966 | Kasket | 426/82 |
| 3,334,803 | 8/1967 | Abbey | 426/77 |
| 3,346,388 | 10/1967 | Andrews et al. | 206/0.5 |
| 3,431,569 | 3/1969 | Gerke | 206/0.5 |
| 3,549,381 | 12/1970 | Kinsinger | 426/77 |
| 3,566,573 | 3/1971 | Irmscher . | |
| 3,597,222 | 8/1971 | Kalemba . | |
| 3,653,913 | 4/1972 | Rambold . | |
| 3,797,642 | 3/1974 | Dorby et al. | 206/0.5 |
| 3,809,215 | 5/1974 | Dorby | 206/0.5 |
| 3,895,118 | 7/1975 | Rambold | 426/82 |
| 3,899,599 | 8/1975 | Rambold | 206/0.5 |
| 4,055,668 | 10/1977 | Kopp | 206/0.5 |
| 4,153,153 | 5/1979 | Herzog | 206/0.5 |
| 4,290,521 | 9/1981 | Mitchell | 206/0.5 |

FOREIGN PATENT DOCUMENTS

| | | |
|---|---|---|
| 0802720 | 12/1968 | Canada . |
| 2053668 | 2/1981 | United Kingdom . |
| 2087350 | 5/1982 | United Kingdom . |

*Primary Examiner*—Steven M. Pollard
*Assistant Examiner*—Jimmy G. Foster
*Attorney, Agent, or Firm*—Donald L. Johnson; John F. Sieberth; Paul H. Leonard

[57] ABSTRACT

An infusion bag for particulated food products such as tea, coffee and the like, constructed of a tube of perforated thermoplastic film or other porous material having a central product containing portion and flattened end portions on each end thereof, the perforated thermoplastic film or other porous material having a multiplicity of minute holes or openings which are sufficiently small in size to prevent the migration of the particulated product therethrough and which are sufficiently large in size and number to permit adequate fluid flow therethrough. Joining together of the flattened end portions forms a flow-through or dual container type infusion bag and a handle for extending over the side of a cup or pot. The film is also substantially odorless and tasteless.

18 Claims, 7 Drawing Figures

INFUSION PACKAGE

This application is a continuation of application Ser. No. 561,824 filed Dec. 15, 1983, now abandoned.

BACKGROUND OF THE INVENTION

The present invention is directed to infusion packages, especially tea packages and the like, and more particularly to an infusion package constructed of a non-woven, fiber-free, perforated thermoplastic film or other porous material.

The invention is particularly concerned with an infusion package constructed of a coextruded multilayer perforated thermoplastic film having a plurality of uniform minute holes or openings therein, which has a relatively flat configuration for packing and which can be readily converted to a dual chamber or flow-through type bag.

At the present time, most tea bags or packages commercially marketed are either the "pillow" pack type or the dual bag or Flo-thru ® type. The bags are made of paper and the latter have strings and tabs attached thereto by staples or glue. Although a considerable degree of success has been achieved with these two types of bags, they have poor wet strength. The single compartment or "pillow" tea bag is a flat bag of liquid pervious material which contains sufficient tea for an individual serving or for multiple servings in the case of the larger packages used by food service industries. The tea spreads the sides of the bag to accommodate the contents. When the tea is wet, it forms a swollen compacted mass that may fill the bag. The swelling tea presses outwardly against the inside walls of the bag. Squeezing or other external pressure on the bag may cause it to break open or split or otherwise undesirably dispel its contents. To overcome this swelling, some bags have been constructed with pleats therein. Although effective to some degree, they have a lack of wet strength and present other problems.

The art is replete with infusion packages containing two or more fill containing segments. The connected segments permit liquid flow between the segments and expose a greater bag surface area to liquid for extraction therethrough. Although such bags may improve brewing, they have the same lack of wet strength of the "pillow" type bags, and present other problems, such as assembly and packaging.

Infusion-type tea packages are usually rectangular packets or sachets made from single or multiple pieces of paper crimped or otherwise sealed along the edges. In another type, a single strip of paper is folded twice longitudinally to form an inner centrally disposed double fold joining the two meeting edges. In a type of flow-through tea bag, a triple transverse fold intermediate the length of the folded strip forms two pockets which are partially filled with tea before the open ends thereof are folded over and stapled to a strand of string usually having a tag on the end thereof.

Over the years, a wide variety of infusion packages or bags, usually for containing tea for subsequent brewing, have been developed. The packages are usually constructed of filter paper or some other type of porous material.

An infusion package which has a natural, expanded or unflattened condition and which is folded to a flattened configuration for packing is disclosed in U.S. Pat. No. 4,290,521. A pull strip with a tab on one end is adhesively attached to the upper part of the package for causing the package to be expanded from its flattened configuration when the strip is pulled.

A type of dosage pack or infusion package having two permeable bags joined to each other along a common seam and arranged in a face-to-face relationship by folding the bags onto one another along a fold line extending in the common seam is described in U.S. Pat. No. 4,055,668. A holder string is positioned between the two bags with one end attached to one of the bags and the other end attached to a tag positioned externally of the two bags.

U.S. Pat. No. 3,899,599 discloses a single chamber or dual chamber tea package which has a flexible strip attached to an exterior side which can be partially removed to provide a hanger for holding the package in place in a container.

An infusion packet having two oppositely disposed, rigidly separated pockets of tea joined together by two tapering end portions which form a narrow, triangular shaped porous cup is shown in U.S. Pat. No. 3,597,222.

U.S. Pat. No. 3,653,913 discloses an infusion bag made from a rectangular strip of porous fibrous material, the longitudinal margins of which are folded together so as to form a longitudinal joint consisting of three layers which are knurled together. The tube is divided by a transverse bend so as to form a pair of chambers for holding an infusible substance, and the opposite ends of the tube are connected to each other so as to close the package.

An early type of tea bag or tea ball wherein the bag is a triangularly-shaped pocket formed from a rectangular strip of perforated aluminum foil is described in U.S. Pat. No. 1,581,578.

Other types of filter paper tea bags or the like with a variety of handles are illustrated in U.S. Pat. No. 2,328,017; U.S. Pat. No. 2,359,292, U.S. Pat. No. 3,566,573; U.S. Pat. No. 4,153,153 and Great Britain Pat. No. 2,087,350. Great Britain Pat. No. 2,053,668 discloses a tea bag having an accordion fold.

Infusion bags with positioning means and flotation means are disclosed in U.S. Pat. No. 3,797,642 and U.S. Pat. No. 3,809,215, respectively. The tea bags themselves may be made of various materials including paper, plastics such as nylon, perforated plastic film, e.g., polyester, or woven or non-woven fabric of natural or synthetic origin.

A percolatable porous bag constructed of a blend of individualized textile or cellulosic fiber and a small amount of thermoplastic fiber is disclosed in Canadian Pat. No. 802,720.

Various degrees of success have been achieved with the foregoing infusion bags or packages, with paper or fibrous bags presently dominating the market place. One of the problems with paper bags is lack of wet strength. Paper packages do not have the strength to withstand squeezing or other pressures commonly applied by consumer or other users.

An infusion bag for items such as tea, coffee or similar food products for brewing must have a number of qualities. It must have an inability to impart a taste factor to the liquid product after brewing. In effect, it must be substantially odorless and tasteless. It must also be sufficiently strong to contain the brewing product in boiling water, e.g., in the steeping of tea, coffee, and similar liquid beverages. The bag must also be porous enough to permit liquid diffusion therethrough, but the pores or openings must be of such size that migration of the beverage material therethrough is inhibited, both when the bag is dry and when the bag has been immersed in a liquid. It is also important that infusion begins to take place within a few seconds and be completed within a few minutes. It is further desirable that a package, bag or sachet, such as a tea sachet, retain sufficient stability that it can be compressed after brewing is completed without destruction of the container.

Thermoplastic films such as polyethylene and polypropylene are common packaging materials. Multilayer films of various types are also quite common packaging materials. The films are generally non-porous and impervious to water and other inert liquids. At least one of the layers of film has strong adhesive qualities. Examples of such multilayer films may be seen in U.S. Pat. No. 4,254,169; U.S. Pat. No. 4,239,826; U.S. Pat. No. 4,233,367; U.S. Pat. No. 3,908,070; U.S. Pat. No. 3,423,231; U.S. Pat. No. 2,817,124 and U.S. Pat. No. 2,817,123.

Perforated thermoplastic films have many useful applications, including packaging of food products such as cheese, gardening and farming to prevent growth of weeds while permitting moisture to be transmitted through the film to the soil beneath and for making absorptive structures such as disposable diapers, for example, see U.S. Pat. No. 3,814,101.

Perforation of thermoplastic films is generally achieved by vacuum perforation of thin plastic films which involves the extrusion of molten polymeric materials such as polyethylene through a slot die. The hot melt web of film exiting the die impinges on a form through which a vacuum is drawn causing the film web to be perforated and holes formed therein. Depending upon the form used, films can be produced which have as few as 50 holes per square inch or which have thousands of holes per square inch. One of the earlier methods for vacuum perforation of plastic film is disclosed in U.S. Pat. No. 3,054,148.

The present invention provides an infusion package or sachet which meets the requirements for tea brewing and additionally overcomes the problems of lack of wet strength and packaging associated with the prior art.

SUMMARY OF THE INVENTION

The infusion bag of this invention is of a poriferous, non-woven, non-fibrous construction of a perforated thermoplastic film or other porous material having a multiplicity of fine holes or openings. The thermoplastic film is preferably a multilayer coextruded film with one outer layer being heat resistant and the other outer layer being somewhat less heat resistant and heat sealable. The openings in the perforated thermoplastic film or porous material are sufficiently small in size to retain particulated products such as tea, coffee or the like within the package and to inhibit or prevent migration of the particles through the holes when the particles are either dry or wet. The holes or openings in the perforated thermoplastic film or porous material are also sufficiently large in size and in number to provide the desired degree of infusion. In a preferred multilayer film, one outer layer of the perforated thermoplastic film is polyester or propylene or other heat resistant thermoplastic. The other outer layer is polyethylene or other somewhat less heat resistant thermoplastic. The perforated thermoplastic film or porous material is substantially odorless and tasteless.

DESCRIPTION OF THE PREFERRED EMBODIMENTS

Figure 1:
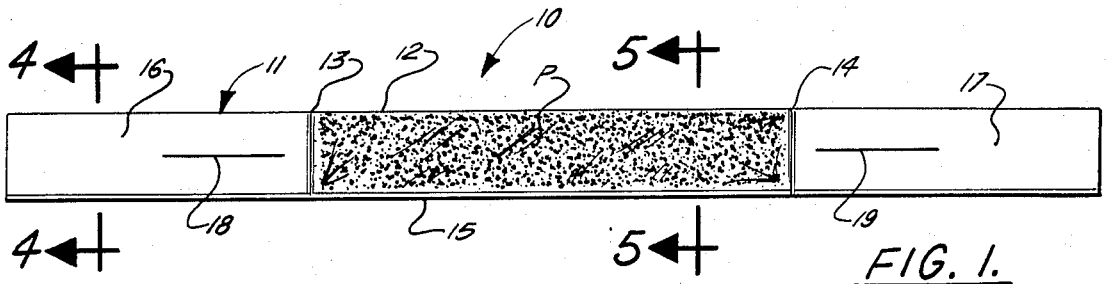
FIG. 1 is a top plan view of an embodiment of the invention.

Referring now to the drawings, an infusion package or bag of the present invention is illustrated generally at 10. The bag or packet 10 is constructed of a rectangular strip of a perforated plastic film 11 which is described in more detail hereinafter. For simplicity of illustration, perforations in the film are not shown. The strip of film 11 is folded longitudinally at 12, sealed at intermediate locations 13 and 14 and filled with a particulated product P which can be seen through the film 11 between the sealings. After the product P is inserted in the sachet 10, the edge 15 is sealed, thereby encasing the product P within the package 10.

The intermediate sealings 13 and 14 provide tabs 16 and 17 on either side of the product P. Conveniently, slits or longitudinal slots 18 and 19 are formed in each of the tabs 16 and 17, respectively.

Figure 2:
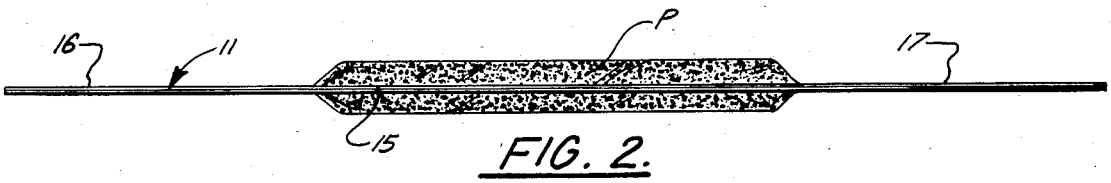
FIG. 2 is a side elevational view of the embodiment of FIG. 1.
Figure 3:
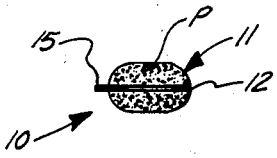
FIG. 3 is an end view of the embodiment of FIG. 1.
Figure 4:
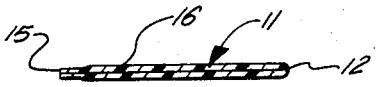
FIG. 4 is a sectional view taken across line 4—4 of FIG. 1.
Figure 6:
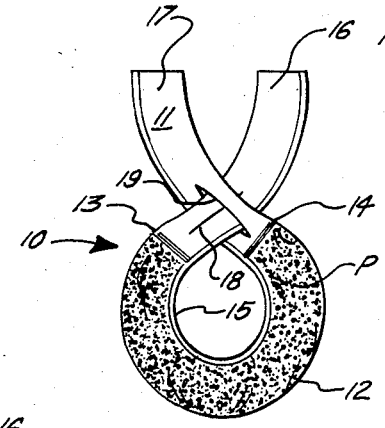
FIG. 6 is a view of the embodiment of FIG. 1 illustrating one means of joining together the ends of the package; and, FIG. 7 is a view similar to that of FIG. 6 illustrating another means of joining the ends of the tea bag.
Figure 5:
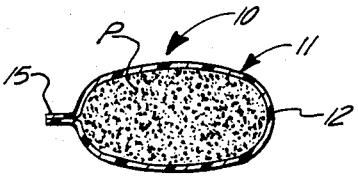
FIG. 5 is a top view taken across line 5—5 of FIG. 1.
Figure 7:
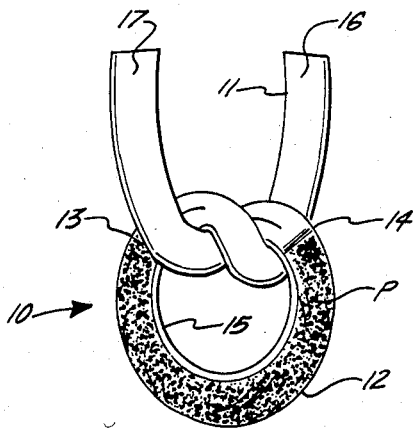

As best seen in FIGS. 1 and 2, the ends of the elongated flattened end portions (or tabs 16 and 17) are located oppositely of the central product containing portion or the portion between the sealings 13 and 14 containing the product P. The flattened end portions are sufficiently elongated that they may be interwoven or knotted together as shown in FIGS. 6 and 7, respectively. Once the package 10 is interwoven or knotted together, a flow through package 10 is formed with an integrated handle thereon. In flow through form, a majority of the central product containing portion is suspended below the handle formed by the flattened end portions.

The infusion package 10 of the present invention is illustrated in its simplest form. Such packages can be readily made on existing filling and packaging machines with minimal modification. The relatively flat shape of the bags permits easy packaging or boxing in a fashion similar to that of boxing cigars.

FIGS. 6 and 7 illustrate two means by which the package 10 is readily converted to a flow through or dual container infusion bag. In FIG. 6, tab 16 is inserted through slot 19 of tab 17. Tabs 16 and 17 are of sufficient length to provide a handle which can readily be extended over the side of a cup or brewing pot.

In FIG. 7, the slots are not used and the tabs are assembled in a half knot or full knot, if desired. The tabs 16 and 17 are sufficiently long to easily provide the desired handles.

The infusion bag or package 10 is preferably constructed of a coextruded multilayer film 11 comprising an outer layer of a heat resistant thermoplastic such as polyester, polyolefin, or the like, with polyester being preferred, and an inner sealant layer of a somewhat less heat resistant thermoplastic such as polyethylene or the like. The film 11 has a multiplicity of fine holes or capillaries which are of a somewhat tapered construction, being more or less in the form of a truncated cone when the holes are round or oval.

For simplicity of illustration, the holes or openings in the film are not shown. It can be appreciated that the openings may be of any desired shape such as round, oval, rectangular, pentagonal, hexagonal or other geometric configuration. It is desired that the holes be uniform and that they be sufficiently large in size and number to provide adequate infusion and be sufficiently small in size to prevent the migration of particles therethrough such as the particulated product P.

In the packaging of an item such as tea, a preferred hole size is from about two to 10 mils, in diameter or across the opening, with a size of three to four mils being most preferred. The film has a thickness of about 0.25 mil to two mils and about 500 holes per square inch or more. About 1800 to 4200 holes per square inch are preferred, with about 2900 holes per square inch being most preferred. The porosity of the film is preferably about 50 to 500 cubic feet per minute (CFM).

The outer layer of the coaxial or coextruded perforated thermoplastic film of the bag is preferably a heat resistant polyester film having a melting temperature of about 425° F. to 600° F. with about 525° F. being most preferred. The inner sealant layer of the coextruded perforated thermoplastic film of the bag is preferably a somewhat less heat resistant polyethylene film having a melting temperature of about 180° F. to 250° F. with 220° F. being most preferred. The use of an outer polyester layer enables a sealing/melting temperature differential of about 150° F. to be obtained. The film has a desired seal strength of ¾ lb. per inch width.

A temperature of about 240° F. is required to melt the polyethylene film for sealing. To prevent sticking of the outer layer of thermoplastic film to the steel jaws of the sealing device or heat sealing machine, it is important that the melting temperature of the polyethylene be kept below about 260° F. It can be appreciated that particular polyolefin resins or other film forming resins may have higher or lower melting temperatures; however, it is essential that a melting temperature differential be obtained between each layer to achieve the desired seal without a deleterious effect on the film.

The edges of the bags and the intermediate sealing areas may be readily heat sealed using standard sealing and automatic bag making machines. The edges and intermediate sealing areas may also be effectively sealed with use of impulse or band type sealers, hot wires, hot air or other suitable apparatuses or techniques.

The longitudinal edge of the film is heat sealed to complete the package. The melt flow of the outer layer must be sufficiently high to prevent the film from sticking to the sealant jaws. The melting temperature of the inner sealant layer must be less than the melting temperature of the outer layer, but sufficiently high to melt the inner layer and achieve the desired seal.

For the packaging of a typical commercial tea for brewing, a perforated thermoplastic film suitable for constructing the infusion bag is a coextruded polypropylene/polyethylene perforated thermoplastic film formed from a high density polyethylene resin and a polypropylene resin. The resins are odorless and tasteless and approved for food packaging.

The film is preferably clear in color, but may be manufactured in its natural color or a variety of colors as desired or permitted by governmental regulations, etc.

The film has a dry surface and has no tendency to stick, cling or "block".

Perforated thermoplastic films suitable for use in the invention has a male side and a female side. In construction of infusion bags, the male side of the film is on the inside of the bag. This relationship effectively seals the tabs of the package which are positioned on either side of the product containing pocket or area.

The invention is illustrated in its simplest form, and as a typical small size infusion bag for the packaging of individual servings of tea for brewing. Larger size packages, such as those customarily used in the food services industry, can also be constructed. Such larger bags can be similarly constructed or constructed of two rectangular strips of film and sealed on all four edges. The bags or packages of the invention can be constructed in other geometrical configurations as desired, but rectangular shaped packages are generally more suitable for boxing or other type of group packaging and can usually be more easily fabricated.

The product is confined to the center portion of the tube and the ends are heat sealed to form the tabs. Other sealing methods can be used if desired, but heat sealing is preferred. The flat tabs also provide a good surface for logos, advertising, instructions or for other printing.

Although the cross-sectional geometry of a filled bag is somewhat circular or oval, it can be of any desired geometrical configuration, for example, a star shape to promote flow and greater surface exposure. In another form of the invention, two narrow strips or ribbons of thermoplastic film are aligned male side to male side. The product, such as tea, is deposited in a thin layer on the top (male) surface of the bottom ribbon. The top ribbon is then laid over the product, sealed along each edge and intermittently spot sealed between the edges in a regular pattern or an irregular portion. The spot seals hold the two ribbons together in close proximity and prevent the product from bunching. The male surfaces of the film are effectively utilized to prevent the tea or other product from bunching thereby keeping maximum tea surface exposed for brewing.

In addition to the advantages set forth hereinbefore, the present invention also provides improved product distribution, offers the possibility of rapid filling, eliminates strings, staples or other extraneous matter. A unique means of squeezing a bag is provided by simultaneously pulling collapsed ends of the tube or package.

Although a coextruded multilayer perforated plastic film is preferred, other types of perforated thermoplastic films may be used. Such films, of course, must provide adequate infusion and sufficient strength for the purposes intended.

Some examples of film forming resins suitable for making the perforated thermoplastic films of which the infusion packages of this invention are constructed are polyethylene (PE), polypropylene (PP), crystalline polyester (CPE), amorphous polyester (APE), polycarbonate (PC) and nylon (N).

Some examples of multilayer films suitable for use in constructing the infusion packages of the invention are, in addition to CPE/PE, as follows:

| | | |
|---|---|---|
| PP/PE | PC/PE | N/PP |
| CPE/PP | PC/PP | N/PE |

-continued

| CPE/APE | PC/APE | N/APE |
|---|---|---|

More detailed examples of suitable perforated coextruded multilayer thermoplastic films are described in copending applications Ser. No. 561,916, Ser. No. 561,825, and Ser. No. 561,823, each of which is filed simultaneously herewith. The applications are specifically incorporated herein.

In addition to dual layer thermoplastic films, triple layer films or films having as many layers as desired can be used. Such films, of course, must be of the perforated type and meet desired infusion rates and packaging requirements.

Although the invention is particularly directed to infusion packages or bags constructed of perforated thermoplastic films, it is suitable for use with other types of porous materials including paper, cloth or other similar type materials. These porous materials must also provide adequate infusion and sufficient strength for the purposes intended.

Although the invention is particularly suitable for the packaging of tea, it can be used for packaging of other types of finely ground or particulated food products such as coffee and grits. The bags may be used for packaging of any items in which infusion of liquids is desired.

The infusion bags of the present invention have excellent wet strength and will not deteriorate in boiling water. The bags themselves are odorless and tasteless and do not impart any foreign taste to the item being packaged. They are, in effect, substantially inert.

The foregoing disclosure and description of the invention is illustrative and explanatory thereof and various changes in the illustrated construction may be made within the scope of the appended claims without departing from the spirit of the invention.

What is claimed is:

1. An infusion package for particulated or finely ground products consisting essentially of a tube of perforated thermoplastic film having a central product containing portion, a product in said central product containing portion, an elongated flattened end portion on each end, said ends being oppositely located ends, each of said flattened end portions of said central product containing portion being sealedly separated from said central product containing portion, said flattened end portions being sufficiently elongated that they may be interwoven or knotted together, whereby when so interwoven or knotted together a flow through type of package with an integrated handle thereon is formed, allowing a majority of said central product containing portion to be suspended below the handle formed by said flattened end portions, said product containing package having sufficient wet strength or stability that it may be compressed after liquid infusion without destruction of the package, and said product containing package being free of any extraneous materials such as staples, strings, tabs, tags, or the like.

2. The infusion package of claim 1, wherein at least one of said flattened end portions has an elongated slot or opening therein which enables one flattened end portion to be inserted through the other flattened end portion and thereby form the flow through type of bag with an integrated handle thereon.

3. The infusion package of claim 1, wherein the package may be lain in a substantially flattened position after filling with a product and a plurality of the packages may be packaged as any group of rectangularly shaped packages.

4. An infusion package for particulated or finely ground products consisting essentially of a tube or perforated thermoplastic film having a central product containing portion and an elongated flattened end portion on each end thereof, said ends being oppositely located ends, each of said flattened end portions being sealedly separated from said central product containing portion, said flattened end portions being sufficiently elongated that they may be interwoven or knotted together, whereby when so interwoven or knotted together a flow through type of package with an integrated handle thereon is formed, allowing a majority of said central product containing portion to be suspended below, at least one of said flattened end portions having an elongated slot or opening therein which enables one flattened end portion to be inserted through the other flattened end portion and thereby form the flow through type of bag with an integrated handle thereon, and said thermoplastic film having a multiplicity of minute uniform holes or openings therein each of which is sufficiently small to inhibit migration therethrough of a particulated product contained in the central product containing portion and is sufficiently large to permit the flow of liquids therethrough.

5. The infusion package of claim 4, wherein the perforated thermoplastic film is a polyester film.

6. The infusion package of claim 4, wherein the film has at least 500 holes per square inch thereof.

7. The infusion package of claim 4, wherein the film has from about 1800 to 4200 holes per square inch thereof.

8. The infusion package of claim 4, wherein the film has from about 2900 holes per square inch.

9. The infusion package of claim 4, wherein the holes of said film are round, oval, rectangular, pentagonal, hexagonal or other desired geometrical shape.

10. The infusion package of claim 4, wherein the openings or holes of said film are about 2–10 mils across at their widest axis.

11. The infusion package of claim 4, wherein the openings or holes of said film are about 3–4 mils across at their widest axis.

12. The infusion package of claim 4, wherein the perforated thermoplastic film is a polyester film, a polycarbonate film, a polypropylene film, a polyethylene film, a nylon film or a combination of such films.

13. The infusion package of claim 4, wherein said package has sufficient wet strength or stability that it may be compressed after liquid infusion without destruction of the package.

14. The infusion package of claim 4, wherein each of said elongated flattened end portions has an elongated slot or opening therein whereby either elongated flattened end portion may be inserted through the other elongated flattened end portion to form the flow through type of bag with an integrated handle thereon.

15. The infusion package of claim 4, wherein said package is free of any extraneous materials such as staples, strings, tabs, tags or the like.

16. The infusion package of claim 4, wherein said flattened end portions have been interwoven or knotted together and a flow through type of package formed.

17. The infusion package of claim 4, wherein after liquid infusion, the liquid may be squeezed therefrom while withdrawing the package from a cup or container.

18. An infusion package for particulated or finely ground products consisting of a tube of porous material having a central product containing portion and an elongated flattened end portion on each end thereof, said ends being oppositely located ends, each of said flattened end portions being sealedly separated from said central product containing portion, said flattened end portions being sufficiently elongated that they may be interwoven or knotted together, whereby when so interwoven or knotted together a flow through type of package with an integrated handle thereon is formed, allowing a majority of said central product containing portion to be suspended below, at least one of said flattened end portions having an elongated slot or opening therein which enables one flattened end portion to be inserted through the other flattened end portion and thereby form the flow through type of bag with an integrated handle thereon, and said porous material having a multiplicity of fine openings or holes therein each of which is sufficiently small in size to inhibit migration therethrough of a particulated product contained in the central product containing portion and is sufficiently large in size to permit the flow of liquids therethrough.

* * * * *

UNITED STATES PATENT AND TRADEMARK OFFICE

CERTIFICATE OF CORRECTION

PATENT NO. : 4,605,123

DATED : August 12, 1986

INVENTOR(S) : Richard W. Goodrum et al

It is certified that error appears in the above-identified patent and that said Letters Patent is hereby corrected as shown below:

Column 2, line 15, " exterior side " should read -- exterior chamber side --;

Column 6, line 7, " has " should read -- have --;

Column 6, line 39, " portion " should read -- pattern --.

Signed and Sealed this

Twenty-eighth Day of October, 1986

[SEAL]

*Attest:*

DONALD J. QUIGG

*Attesting Officer* *Commissioner of Patents and Trademarks*